US006401685B1

(12) United States Patent
Warner

(10) Patent No.: US 6,401,685 B1
(45) Date of Patent: Jun. 11, 2002

(54) CARBURETOR WITH A FUEL SHUT OFF SOLENOID

(75) Inventor: Donald W. Warner, Cass City, MI (US)

(73) Assignee: Walbro Corporation, Cass City, MI (US)

( * ) Notice: Subject to any disclaimer, the term of this patent is extended or adjusted under 35 U.S.C. 154(b) by 0 days.

(21) Appl. No.: 09/776,443

(22) Filed: Feb. 2, 2001

(51) Int. Cl.[7] ..... F02M 7/12

(52) U.S. Cl. ..... 123/198 DB; 123/337; 123/438

(58) Field of Search ..... 123/337, 198 DB, 123/438, 336, DIG. 11; 251/365, 129.09, 129.1, 129.15

(56) References Cited

U.S. PATENT DOCUMENTS

| | | | | | |
|---|---|---|---|---|---|
| 3,810,489 | A | * | 5/1974 | MacManus et al. | 137/495 |
| 4,111,176 | A | * | 9/1978 | Fenton et al. | 123/198 DB |
| 4,253,437 | A | * | 3/1981 | Haramoto | 123/325 |
| 4,545,350 | A | * | 10/1985 | Nakamura et al. | 123/439 |
| 4,598,679 | A | * | 7/1986 | Ohkumo et al. | 123/325 |
| 5,168,957 | A | * | 12/1992 | Ross | 180/287 |
| 5,649,687 | A | * | 7/1997 | Rosas et al. | 251/129.15 |
| 5,752,489 | A | * | 5/1998 | Henderson et al. | 123/494 |
| 5,809,971 | A | * | 9/1998 | Svensson et al. | 123/438 |
| 5,809,979 | A | * | 9/1998 | Tsuda et al. | 123/525 |
| 6,082,323 | A | * | 7/2000 | Winberg | 123/198 DB |
| 6,213,083 | B1 | * | 4/2001 | Winberg | 123/198 DB |

FOREIGN PATENT DOCUMENTS

| | | | | |
|---|---|---|---|---|
| JP | 95840 | * | 7/1979 | F02M/17/38 |
| JP | 350331 | * | 12/1992 | F02M/1/02 |
| JP | 135513 | * | 5/1996 | F02M/21/02 |
| JP | 60558 | * | 3/1997 | F02M/19/00 |

* cited by examiner

*Primary Examiner*—Tony M. Argenbright
*Assistant Examiner*—Hai Huynh
(74) *Attorney, Agent, or Firm*—Reising, Ethington, Barnes, Kisselle, Learman & McCulloch, P.C.

(57) ABSTRACT

A fuel shut off solenoid device of a carburetor has a solenoid chamber which typically fills with fuel. When the solenoid device is energized, fuel flows from a fuel chamber into a mixing passage of the carburetor to mix with air. During the energized state, heat from the solenoid tends to vaporize the fuel within the solenoid chamber. Also when energized, the solenoid device is held in a retracted position whereby a head at a distal end of the shaft mates with or seals to a washer which in turn seals to an upward face of the encasement of the fuel shut off solenoid device. Thus the potential migration of large vapor bubbles from the solenoid chamber to the mixing passage of the carburetor is eliminated, providing a smoother idling or running engine at light loads.

16 Claims, 3 Drawing Sheets

CARBURETOR WITH A FUEL SHUT OFF SOLENOID

FIELD OF THE INVENTION

This invention relates to a carburetor for small engines, and more particularly to a carburetor having a fuel shut off solenoid device.

BACKGROUND OF THE INVENTION

The use of solenoid devices to control a variety of fuel flow transients within a carburetor of a small engine is known. One particular application consists of a fuel shut off solenoid device of a carburetor capable of blocking fuel flow from entering a mixing passage of the carburetor when an ignition switch is turned off, thereby preventing engine dieseling and after boom. When the ignition switch is on, the solenoid device is energized and thereby held in a retracted position. If retracted, fuel flows from a fuel bowl, through a main tube or nozzle where the fuel premixes with air, and into the carburetor mixing passage to mix with more air. When the ignition switch is off, the solenoid device is de-energized and a head at a distal end of a shaft of the solenoid device is extended upward thereby isolating the fuel bowl from the main tube and effectively cutting off fuel flow.

The solenoid device is typically mounted in an upright position below the carburetor body. A solenoid chamber defined by an encasement of the device is usually disposed below the fuel bowl. When the head extends, the shaft of the solenoid device moves upward out of the solenoid chamber and the head mates with the bottom side of the main tube to cut off fuel flow. Because the solenoid chamber is located beneath the fuel bowl of the carburetor and a clearance exists between the shaft and the encasement of the solenoid device, fuel migrates via gravity into the solenoid chamber.

SUMMARY OF THE INVENTION

Although the migrating fuel was thought to be useful in cooling the energized solenoid device, it has been found that heat emitted by the coil of the energized solenoid device vaporizes the fuel contained within the solenoid chamber. The heat generated by the solenoid valve heats the fuel thereby creating vapor bubbles which migrate up through the main nozzle, interfering with steady or smooth operation of the engine. The bubbles interfere with the mixing of fuel and air causing a noticeably rough engine idling or light load condition. Accordingly, the present invention is a carburetor having a fuel shut off solenoid device which does not inject fuel vapor into the liquid fuel.

A carburetor body of the carburetor has an inner sidewall defining a mixing or lower chamber disposed above the fuel shut off solenoid device. A fuel chamber containing a constant level of fuel is defined by a fuel bowl engaged to an outward or underside of the carburetor body. Fuel flows through an orifice communicating between the fuel chamber and the lower chamber. The lower chamber communicates with an elongated main tube or nozzle defining an enriched fuel bore and extending longitudinally upward from the lower chamber and tranversely into a mixing passage. The main tube has a mating surface on a lower end facing downward and extending radially outward thereby engaging the sidewalls of the lower chamber.

The fuel shut off solenoid device has an encasement which threadably engages a bottom portion of the carburetor body. The encasement defines a solenoid chamber which houses an extendable shaft having a head at a distal end disposed above the encasement. The solenoid chamber contains migrating fuel thought to cool the solenoid coil. The shaft is disposed vertically within the solenoid chamber and extends upward through an outward face extending radially outward from an inner brim which circles the shaft. Mounted on top of the outward face and also circling the shaft, is a washer. When the solenoid is energized and in a retracted position, a head of the shaft engages to an outward face of the washer. The outward face of the encasement engages to the inward or opposite face of the washer.

The head of the shaft has an annular trailing surface expanding radially outward from an inner perimeter edge congruent to the surface of the shaft, to a peripheral edge. The trailing surface of the head confronts the outward face of the encasement. The peripheral edge of the trailing surface has a diameter larger than the diameter of a hole of the washer.

A clearance is defined radially between the shaft and the inner brim of the encasement. Fuel flows or migrates through the clearance between the lower chamber of the carburetor body and the solenoid chamber. While energized, the fuel shut off solenoid device has a tendency to heat the fuel in the solenoid chamber thereby creating vapor bubbles which can interfere with the idle or light load fuel mixture of the carburetor. The engagement of the washer between the trailing surface of the head and the outward face of the energized solenoid device partially blocks or stops the migration of fuel vapor bubbles from the solenoid chamber into the lower chamber.

Objects, features and advantages of this invention include the elimination of fuel vapors migrating from the solenoid chamber into the lower chamber of the carburetor body, a smoother operating engine, particularly noticeable during engine idling or light load conditions, and which is rugged, durable, economical to manufacture and assemble, and has a long useful service life.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
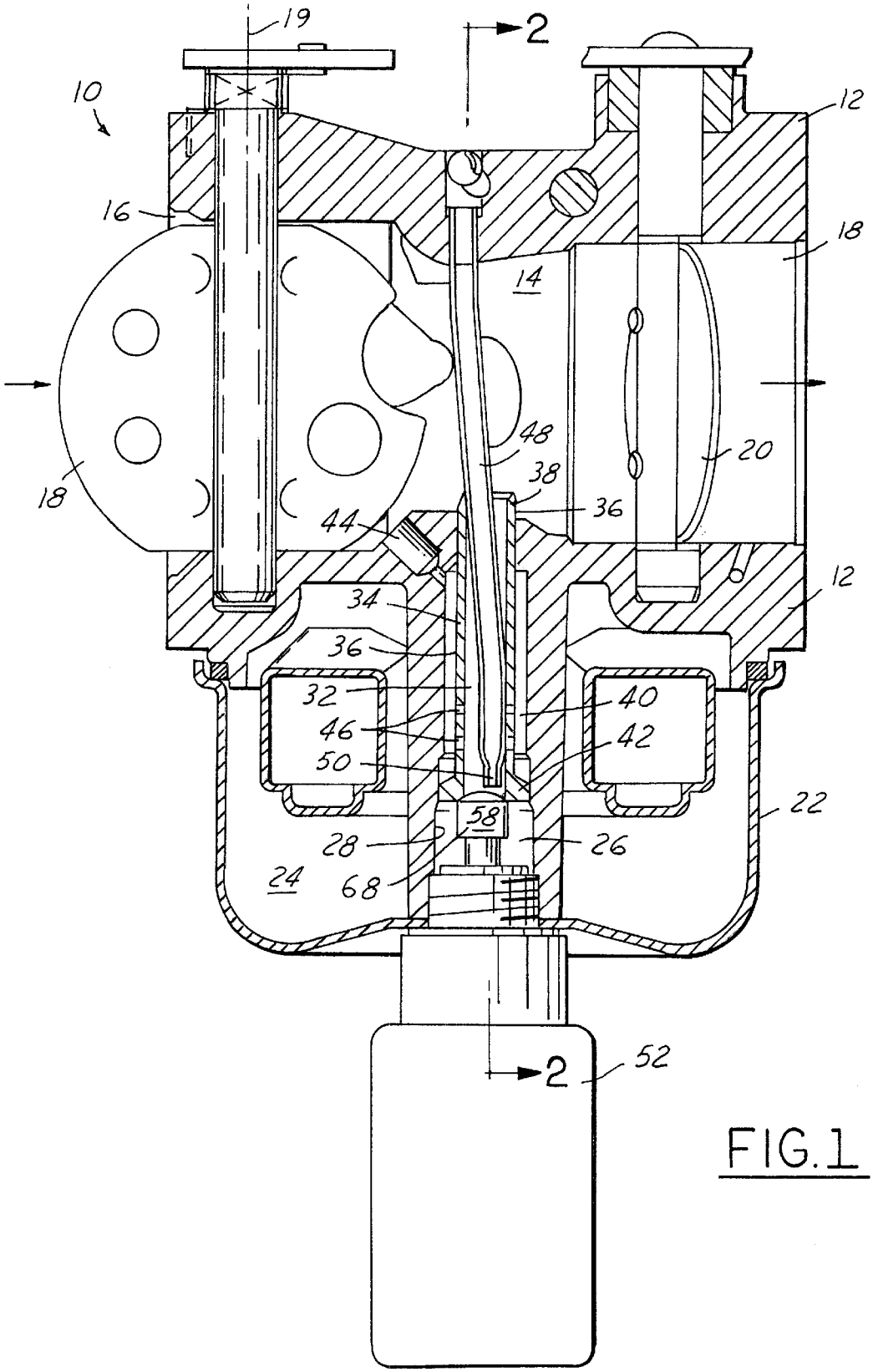
FIG. 1 is a broken cross sectional side view of a carburetor according to the present invention.

Referring in more detail to the drawings, FIG. 1 illustrates a carburetor 10 embodying the present invention with a carburetor body 12 having a mixing passage 14 through which air flows in the direction of the arrows. An air inlet portion 16 of the mixing passage 14 is positioned downstream of an air filter unit (not shown). The air inlet portion 16 houses a pivoting choke plate 18 having a pivotal axis 19 perpendicular to the longitude of the mixing passage 14. The choke plate 18 is substantially closed during cold engine start conditions thereby controlling or limiting the air intake. Downstream of the air inlet portion 16 is a fuel and air mixture outlet portion 18 of the mixing passage 14. The outlet portion 18 houses a pivoting throttle plate 20, similar to the choke plate 18, but which controls the amount of fuel and air mixture entering a running engine. With the engine running, the air pressure at the air inlet portion 16 is near atmospheric minus the pressure drop across the air filter unit (not shown).

Figure 2:
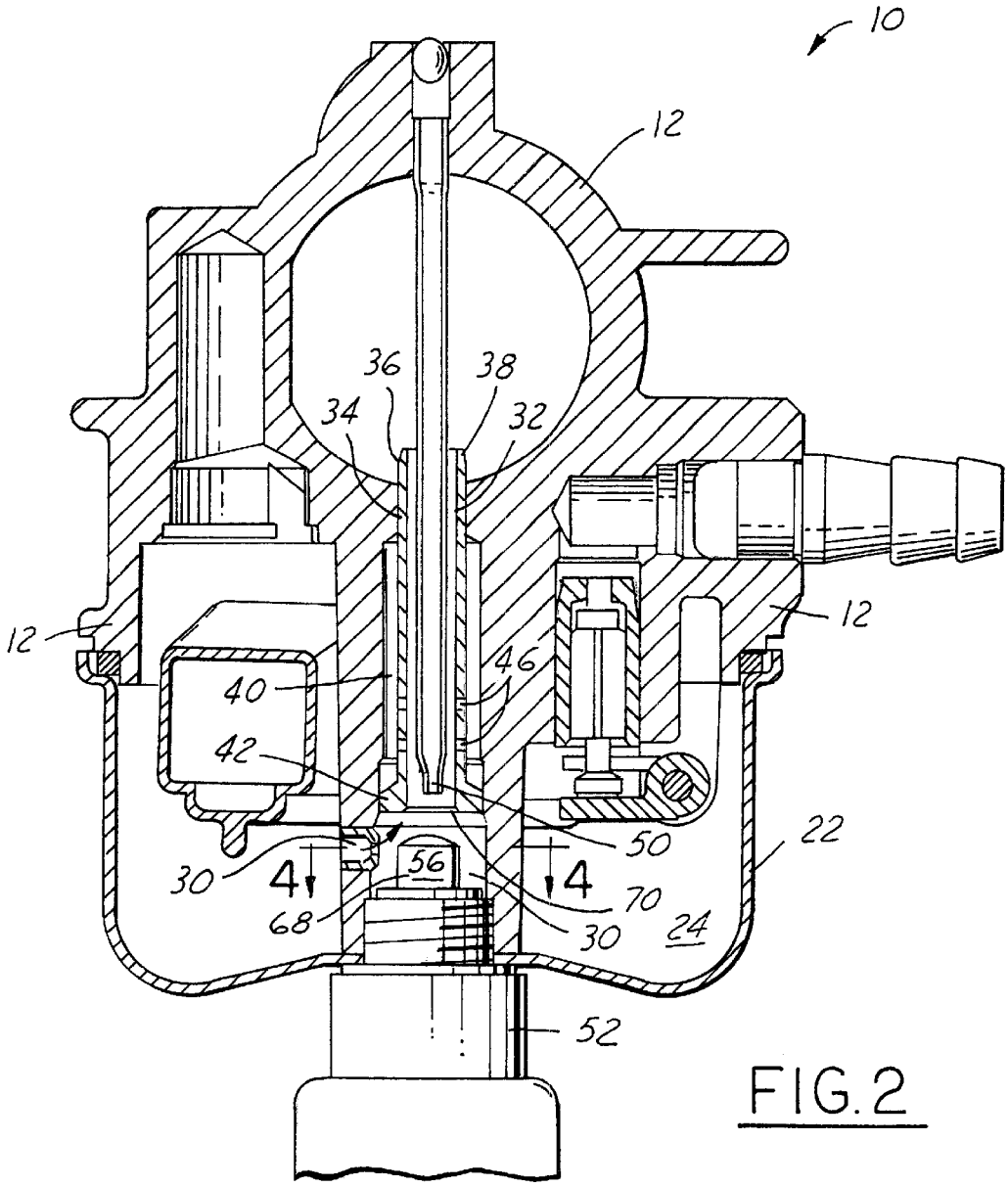
FIG. 2 is a partial cross sectional view of the carburetor taken along line 2—2 of FIG. 1.
Figure 4:
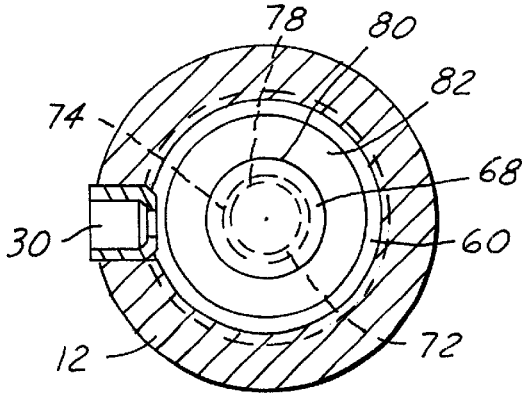
FIG. 4 is a partial cross sectional view of the carburetor taken along line 4—4 of FIG. 2.

Referring to FIGS. 1 and 2, the longitude or axis of the mixing passage 14 is preferably horizontal. A fuel bowl 22 engages the carburetor body 12 from beneath thereby defining a fuel chamber 24 between them. The fuel chamber 24 maintains a consistent level of fuel via a float mechanism. In operation, fuel flows from the fuel chamber 24 through an orifice 30 and into a lower or mixing chamber 26 of the carburetor body 12. A preferably cylindrical side wall 28 of the carburetor body 12 defines in part the lower chamber 26. The orifice 30 penetrates a dividing portion of the carburetor body 12 through the side wall 28 thereby communicating between the fuel chamber 24 and the lower chamber 26, as shown in FIGS. 2 and 4.

During engine operation under non-idle conditions, fuel and air flows upward via negative pressure from the lower chamber 26, through a bore 32 defined by an elongated main or nozzle tube 34, and into the mixing passage 14 between the choke plate 18 and the throttle plate 20. An upper end portion 38 of the main tube 34 extends substantially perpendicular into the mixing passage 14. The main tube 34 has an outer surface 36 which engages the carburetor body 12 at the upper end portion 38 of the main tube 34. The carburetor body 12 and the tube 34 define an upper annular chamber 40 disposed above the lower chamber 26 and beneath the upper end portion 38 of the main tube 34. The main tube 34 has a lower end 42 which flares radially outward to sealably engage the carburetor body side wall 28 beneath the upper chamber 40, thereby isolating the lower chamber 26 from the upper chamber 40. The lower chamber 26 is generally filled with fuel and the upper chamber 40 is approximately half filled with fuel during steady state engine operating conditions.

Air enters into the upper chamber 40, through a choke bore 44 which communicates with the air inlet portion 16 of the mixing passage 14 at the downstream side of the choke plate 18 and upstream from the protruding upper end portion 38 of the main tube 34, shown in FIG. 1. In operation, the upper chamber 40 is slightly below atmospheric pressure and fuel and air flows from the upper chamber 40 into the bore 32 through a plurality of transverse holes 46 which penetrate the wall of the main tube 34 near the lower end 42. An overly rich fuel-to-air mixture flows through the bore 32 and into the mixing passage 14 to mix with additional air. In operation, because the fuel bore 32 is below atmospheric pressure, the combination of choke bore 44, upper chamber 40 and plurality of holes 46 function together (as a fuel pump) to cause fuel to flow from the fuel chamber 24 into the mixing passage 14 for mixing with flowing air between the choke plate 18 and the throttle plate 20.

During engine idle running conditions, fuel flows not via the "fuel pump" but from the lower portion of the bore 32 into an idle fuel feed tube 48 by a vacuum drawn from the intake manifold, not shown. Feed tube 48 extends transversely across the mixing passage 14 between the choke and throttle plates 18, 20 and generally longitudinally into the main tube 34 through the upper end 38. A distal or intake nozzle end 50 of feed tube 48 terminates slightly above the flared lower end 42 of the main tube 34.

Figure 3:
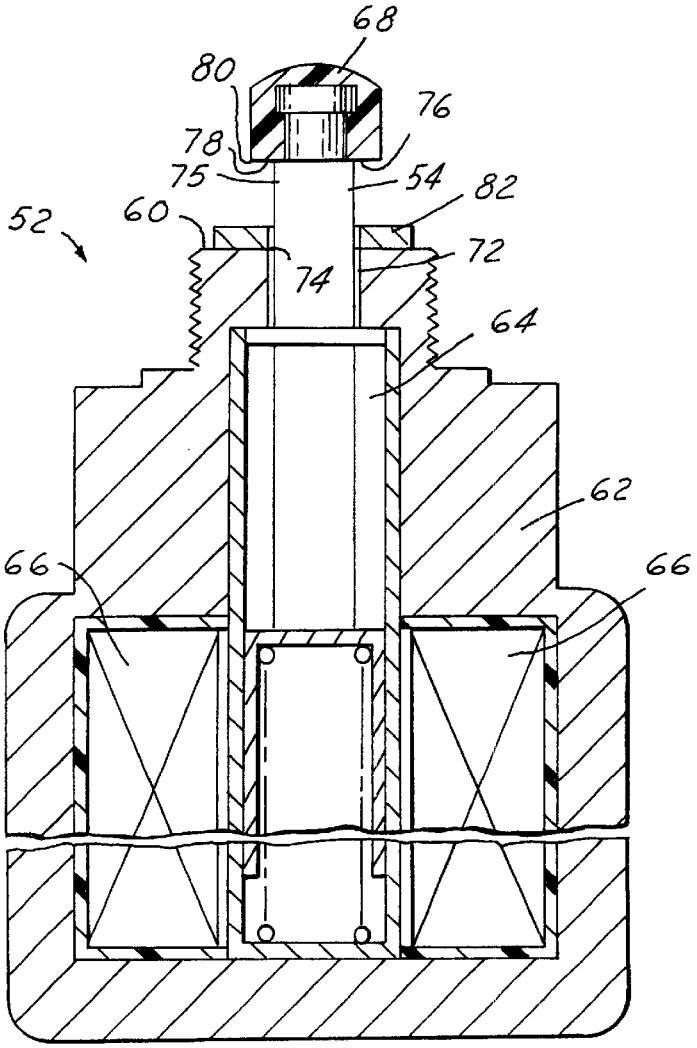
FIG. 3 is a longitudinal cross sectional view of the fuel shut off solenoid of the carburetor.

Referring to FIGS. 2–4, turning off the ignition of the running engine causes a fuel shut-off solenoid device 52 to isolate fuel flow from the lower chamber 30 into the enriched-fuel bore 32, preventing engine dieseling and after boom. The solenoid device 52 mounts to carburetor body 12 from beneath and has a shaft 54 which moves vertically from an energized or retracted position 56 (shown in FIG. 2) to a de-energized or extended position 58 (shown in FIG. 1) into the lower chamber 26. A mid portion of the shaft 54 moves transversely through an outward face 60 of an encasement 62 of the solenoid device 52. In assembly, the outward face 60 defines the bottom of the lower chamber 26, and the encasement 62 defines a solenoid chamber 64 which houses a substantial portion of the shaft 54. An electrical coil 66 is encased within the encasement 62 and winds about the solenoid chamber 64.

When the electrical coil 66 is energized, the shaft 54 is moved to and retained in the retracted position 56 and fuel is free to flow from the lower chamber 26 to the enriched-fuel bore 32. However, when the electrical coil 66 is de-energized the shaft 54 is moved to and retained in the extended position 58. When extended, a head 68 of at a distal end of the shaft 54 engages a downward facing mating surface 70 formed by the radial flaring of the lower end 42 of the main tube or nozzle 34. The nozzle end 50 of the idle fuel feed tube 48 is suspended slightly above the head 68. Therefore, fuel flow is not completely isolated from the idle fuel feed tube 48 when the head 68 engages the mating surface 70. Of course, if tolerances can be achieved within a reasonable manufacturing cost, it is preferable to seal off the nozzle end 50 in addition to the main tube 34 utilizing the head 68.

Fuel migrates from the lower chamber 26 into the solenoid chamber 64 through a clearance 72 defined radially between an inner brim 74 of the outward face 60 of the encasement 62 and a cylindrical surface 75 of the shaft 54. The fuel within the solenoid chamber 64 cools the constantly energized solenoid device 52 of a running engine.

The head 68 of the shaft 54 flares laterally outward thereby forming a trailing face 76. The trailing face 76 is preferably annular and is defined radially between an inner perimeter edge 78 which is congruent to the cylindrical surface 75 of the shaft 54 and a peripheral edge 80 of the radially enlarged head 68. Preferably, the trailing face 76 is substantially parallel to the outward face 60 of the encasement 62. When shaft 54 is in retracted position 56, the trailing face 76 is interconnected sealably to the outward face 60 to prevent the release of vaporized fuel or bubbles from the solenoid chamber 64 into the lower chamber 26.

Figure 5:
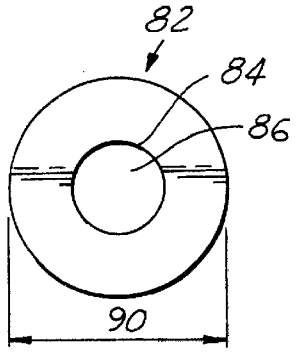
FIG. 5 is a plain top view of a washer of the fuel shut off solenoid device.
Figure 6:
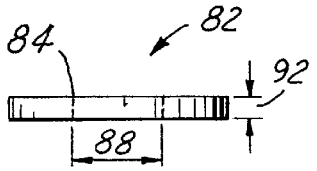
FIG. 6 is a side view of the washer.

Referring to FIGS. 3, 5 and 6, when in use heat generated by the electrical coil 66 within the solenoid 52 creates vapor bubbles within the solenoid chamber 64. Without a sealing engagement between the head 68 and the encasement 62 of the solenoid 52, large bubbles would be emitted through the clearance 72 and into the lower chamber 26 causing rough idle or light load conditions of the running engine. To complete the sealing engagement, preferably a washer 82 is utilized about the shaft 54 between the head 68 and the outward face 60 of the encasement 62. The washer 82 has an inner perimeter edge 84 which is slightly larger than the inner perimeter edge 78 of the shaft 54. This permits the washer 82 to move freely up and down the shaft 54 without interfering with the extending and retracting movement of the shaft 54. The inner perimeter edge 84 however is smaller than the peripheral edge 80 of the head 68. Therefore, when the shaft 54 is in the retracted position 56 the trailing face 76 mates with the upward surface of the washer 82, and the lower surface of the washer 82 mates with the outward face 60 of the encasement 62. In short, preferably the diameter of the hole 86 of the washer 82 is larger than the diameter of the shaft 54 and smaller than the outside diameter of the face 76 of the head 68.

Preferably, the head 68 is an elastomer grommet, and the washer 82 is of a non-corrosive material having a low heat capacity such as plastic and provides a seal with the face 60 of the encasement 62.

In one embodiment of the invention, utilizing a fuel cut-off solenoid valve manufactured by Bicron, Inc. (Walbro Engine Corporation part number 76-521) and utilizing a Walbro Engine Corporation Carburetor Assembly part number LMK-106, a central hole 86 defined by the inner perimeter edge 84 of the washer 82 has a diameter 88 equal to 0.136 plus or minus 0.005 inches. An outer diameter 90 of the washer 82 is equal to 0.300 plus or minus 0.005 inches, and the thickness length 92 of the washer 82 is 0.031 plus or minus 0.003 inches. The washer is made of plastic.

While the forms of the invention herein disclosed constitute a presently preferred embodiment many others are possible. For instance, the trailing face 76 of the head 68 or elastomer grommet can seal directly to the outward face 60 of the solenoid 52 thereby eliminating the need for the washer 82. Regardless, it is not intended herein to mention all the possible equivalent forms or ramifications of the invention. It is further understood that the terms used herein are merely descriptive rather than limiting, in that various changes may be made without departing from the spirit or scope of this invention.

I claim:

1. A fuel shut-off solenoid device for a carburetor, the solenoid device comprising:

an encasement having an outward face and an inner brim;

a solenoid chamber defined by the encasement below the outward face;

a shaft disposed within the solenoid chamber and extending through the outward face radially inward of the inner brim, the shaft having a head at a distal end and disposed outward from the outward face of the encasement, the head having a trailing face, a peripheral edge and an inner perimeter edge, the trailing face defined between the peripheral edge and the inner perimeter edge, the trailing face opposing the outward face of the encasement, and the peripheral edge larger than the inner brim of the outward face;

an electrical coil aligned axially with the solenoid chamber, the electrical coil encapsulated by the encasement and isolated from the solenoid chamber, the shaft capable of movement between an extended position and a retracted position upon energizing the coil; and a clearance defined radially between the shaft and the inner brim of the encasement, the clearance communicating with the solenoid chamber wherein fuel migrates into the solenoid chamber through the clearance when the shaft is in the extended position, the trailing face of the head of the shaft sealing with the outward face of the encasement when the shaft is in the retracted position.

2. The solenoid device as set forth in claim 1 wherein the shaft is in the extended position when the coil is deenergized and in the retracted position when the coil is energized.

3. The solenoid device as set forth in claim 2 further comprising a washer disposed axially between the head of the shaft and the outward face of the encasement, the washer having an inner perimeter edge defining a hole, the shaft extending through the hole, the inner perimeter edge of the washer being smaller than the peripheral edge of the head, the washer being engaged sealably between the trailing face of the head and the outward face of the encasement when the shaft is in the retracted position.

4. The solenoid device as set forth in claim 3 wherein the shaft is aligned vertically, the head moving upward when the shaft moves from the retracted position to the extended position.

5. The solenoid device as set forth in claim 4 wherein the trailing face of the head, the outward face of the encasement, the washer, and the shaft are aligned concentrically to one another.

6. The solenoid device as set forth in claim 5 wherein the head comprises an elastomer grommet.

7. The solenoid device as set forth in claim 6 wherein the washer is plastic.

8. The solenoid device as set forth in claim 7 wherein the washer is free to move axially along the shaft when the shaft is in the extended position.

9. A carburetor having a fuel shut-off solenoid device, the carburetor comprising:

the fuel shut-off solenoid device having:

an encasement having an outward face and an inner brim, a solenoid chamber defined by the encasement below the outward face, a shaft disposed vertically within the solenoid chamber and extending upward through the outward face radially inward of the inner brim, the shaft having a head at a distal end expanded radially and disposed above the outward face of the encasement, the head having a trailing face, a peripheral edge and an inner perimeter edge, the trailing face defined between the peripheral edge and the inner perimeter edge, the trailing face opposing the outward face of the encasement, and the peripheral edge larger than the inner brim of the outward face, an electrical coil aligned axially with the solenoid chamber, the electrical coil encased by the encasement, the shaft being in an extended position when the coil is deenergized and in a retracted position when the coil is energized, and a clearance defined radially between the shaft and the inner brim of the encasement, the clearance communicating with the solenoid chamber wherein fuel migrates into the solenoid chamber through the clearance when the shaft is in the extended position, the trailing face of the head being sealed with the outward face of the encasement when the shaft is in the retracted position;

a carburetor body;

a lower chamber disposed within the carburetor body, the lower chamber defined by a sidewall of the carburetor body and the outward face of the encasement;

a fuel chamber defined by a fuel bowl carried by the carburetor body;

an orifice defined by the carburetor body and communicating between the fuel chamber and the lower chamber;

an elongated main tube disposed within the carburetor body and defining a bore communicating with the lower chamber; and a mating surface further defining the lower chamber and extending perpendicularly between the end of the main tube and the sidewall of the carburetor body, the head of the shaft sealably engaging the mating surface when the shaft is in the extended position.

10. The carburetor as set forth in claim 9 further comprising an idle fuel feed tube having a nozzle end extending longitudinally into the main tube toward the lower chamber.

11. The carburetor as set forth in claim 10 further comprising a washer disposed axially between the head of the shaft and the outward face of the encasement, the washer having an inner perimeter edge defining a hole, the shaft extending through the hole, the inner perimeter edge of the washer being smaller than the peripheral edge of the head, and the washer engaged sealably between the trailing face of the head and the outward face of the encasement when the shaft is in the retracted position.

12. The carburetor as set forth in claim 11 wherein the trailing face of the head, the outward face of the encasement, the washer, and the shaft are aligned concentrically to one another.

13. The carburetor as set forth in claim 12 wherein the head comprises an elastomer grommet.

14. The carburetor as set forth in claim 13 wherein the washer is plastic.

15. The carburetor as set forth in claim 14 wherein the washer is free to move axially along the shaft when the shaft is in the extended position.

16. The carburetor as set forth in claim 10 wherein the nozzle end mates sealably with the head when the shaft is in the extended position.

* * * * *